United States Patent [19]

Loane

[11] Patent Number: 5,020,793

[45] Date of Patent: Jun. 4, 1991

[54] SKI EXERCISING APPARATUS

[76] Inventor: R. Joel Loane, 535 Placitas Ave., Atherton, Calif. 94025

[21] Appl. No.: 426,881

[22] Filed: Oct. 24, 1989

Related U.S. Application Data

[63] Continuation-in-part of Ser. No. 178,354, Apr. 6, 1988.

[51] Int. Cl.[5] ..... A63B 69/18

[52] U.S. Cl. ..... 272/97; 272/142; 434/253

[58] Field of Search ..... 272/70, 97, 94, 96, 272/69, 93, 120, 128, 134, 85, 142; 434/253; 128/25 R

[56] References Cited

U.S. PATENT DOCUMENTS

| | | | |
|---|---|---|---|
| 3,524,641 | 8/1970 | Ossenkop | 272/97 |
| 3,731,919 | 5/1973 | Schurch | 272/97 |
| 3,831,935 | 8/1974 | Hofle | 272/97 |
| 4,743,014 | 5/1988 | Loane | 272/97 |
| 4,850,585 | 7/1989 | Dalebout | 272/70 |

*Primary Examiner*—Stephen R. Crow
*Attorney, Agent, or Firm*—Joseph H. Smith

[57] ABSTRACT

A ski exercising apparatus has a carriage restrained by resilient elements to restore the carriage toward a middle position when displaced by a user simulating parallel skiing, and a single foot platform arranged on the carriage as a swing, so the force applied by a user causes the foot surface of the platform to swing to a position with the surface at substantially a right angle with the direction of the force.

3 Claims, 3 Drawing Sheets

SKI EXERCISING APPARATUS

CROSS REFERENCE TO RELATED APPLICATIONS

This application is a continuation-in-part of U.S. patent application Ser. No. 178,354, entitled Ski Exercising Apparatus, filed Apr. 6, 1988, by R. Joel Loane, incorporated herein by reference.

FIELD OF THE INVENTION

This invention relates to exercising apparatus for allowing a user to simulate the motions, exertions and techniques involved in skiing, therby increasing the user's strength and skill, and more particularly to improvements in such apparatus.

BACKGROUND OF THE INVENTION

Apparatus for use by skiers on which they may simulate the motions, exertions and techniques required in skiing has been built and sold for several years. In particular U.S. Pat. No. 3,524,641 was issued to Robert J. Ossenkop on Aug. 18, 1970, for a device comprising a movable carriage on a set of rails. The carriage of that device is constrained in its movement on the rails by flexible members attached to both the carriage and to transverse members between the rails near each end of the set of rails, and a user can move the carriage from side to side on the rails to simulate the Wedeln or "parallel" technique of skiing.

U.S. Pat. No. 3,547,434 was issued to the same inventor on Dec. 15, 1970. This later referenced patent is for a device similar to the first device, but comprising a number of improvements, such as moveable platforms acting as footrests on the carriage whereby a user may simulate turning and edging techniques in addition to parallel skiing, and in some embodiments may also move the feet relative to one another.

The inventions referenced above each include a safety strap attached to a transverse member between the parallel rails and to the carriage on the rails in addition to the flexible member by which the carriage is constrained to travel on the rails. The purpose of the safety strap is to provide for the situation in which the aforementioned flexible member might rupture on one side of the carriage, providing a sudden force urging the carriage to the side where the flexible member remains unruptured, which sudden force could dislodge a user and perhaps cause serious injury. The safety strap in such instance provides a restoring force toward the center tending to lessen the amplitude of carriage displacement that might otherwise occur.

On May 10, 1988 U.S. Pat. No. 4,743,014 issued to R. Joel Loane, the present inventor, for a device similar to the devices taught by Ossenkop. The device patented to Loane on May 10, 1988 has a pair of spaced apart rails, a platform for riding on the rails, a first resilient element providing a first restoring force on the platform, and a second resilient element providing a second restoring force on the platform. The second resilient element has an adjustment element contacting the second resilient element in at least three points.

The copending parent application to the instant application, Ser. No. 178,354, discloses and claims improvements to the device of U.S. Pat. No. 4,743,014. One improvement is a longer first resilient element passing around roller elements at the ends of the device and fastening to a centrally located brace element. Another improvement is an off-center mounting of each of two foot pad platforms on the riding carriage, placing the pivot of each somewhat toward the edge of each away from the other platform, so the weight of a user and his action in shifting his weight in operating the ski exerciser will cause each platform to initially rotate in the correct direction to simulate edging technique.

In all of the ski exercising apparatus thus far, as illustrated by the above referenced patents and pending application, there are two foot platforms, one for each of a user's feet, and the platforms are mounted to other elements of the exerciser in each instance by apparatus, such as pivot rods, that is mounted below each foot platform. In marketing these devices, it has become apparent that there are users who wish to use such a device, but find the devices difficult to use or not suited to the particular use they desire. These potential users want a device with a single foot platform. Some have only one leg. Others simply wish to exercise with one leg at a time to place more stress and demand on the one leg used. Accordingly a device is needed with a single foot platform, and mounted and operable to serve the needs of the aforementioned potential users.

SUMMARY OF THE INVENTION

A ski exercising apparatus is provided in which a carriage rides on a set of parallel rails, and the carriage is restrained by resilient elements that urge the carriage toward a middle position on the rails whenever the carriage is displaced from the middle position. A single foot platform on the carriage for one of a user's feet is pivoted above the surface for the user's foot around a pivot axis that is directed substantially at a right angle to the direction of carriage travel. The single foot platform thus acts as a swing, and the surface for the user's foot automatically adjusts in action to be substantially at a right angle to the line of action of a user's weight while operating the apparatus.

In an alternative embodiment a second resilient element acting as a safety strap in the event that the first might break is attached to the carriage with an adjusting apparatus contacting the second resilient in at least three points. The second and third of the three points are moveable to accomplish adjustment.

In practice, the invention has proved to be invaluable for use by elite athletes, single-legged skiers, water skiers, and anyone who wants an intense and challenging workout. The invention provides a tool for athletes who need to keep in peak condition while one leg is injured and is excellent for cross training, both for aerobic and anaerobic workouts. Most importantly, however, the device is the first really practical exercise apparatus specifically designed to meet the needs of single-legged athletes, a class of individuals which has demonstated clearly to the world that being single-legged does not have to put a stop to superior athletic performance.

DESCRIPTION OF THE PREFERRED EMBODIMENTS

Figure 1A:
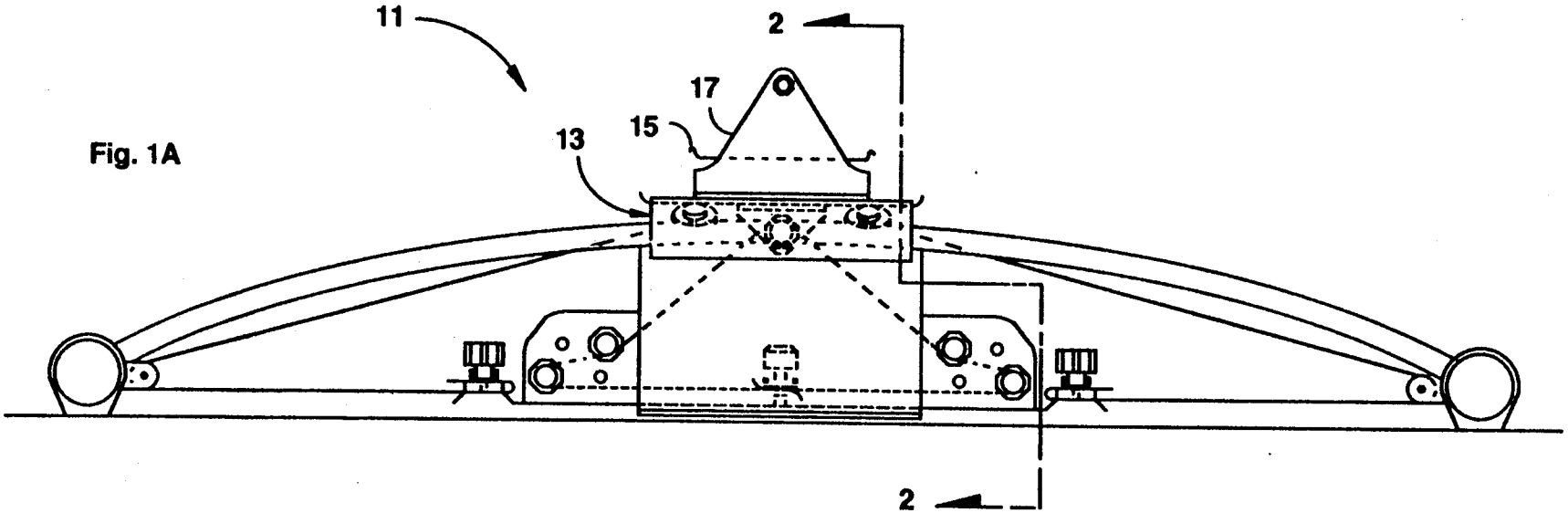
FIG. 1A is a side elevation view of a ski exercising apparatus according to a preferred embodiment of the invention.
Figure 1B:
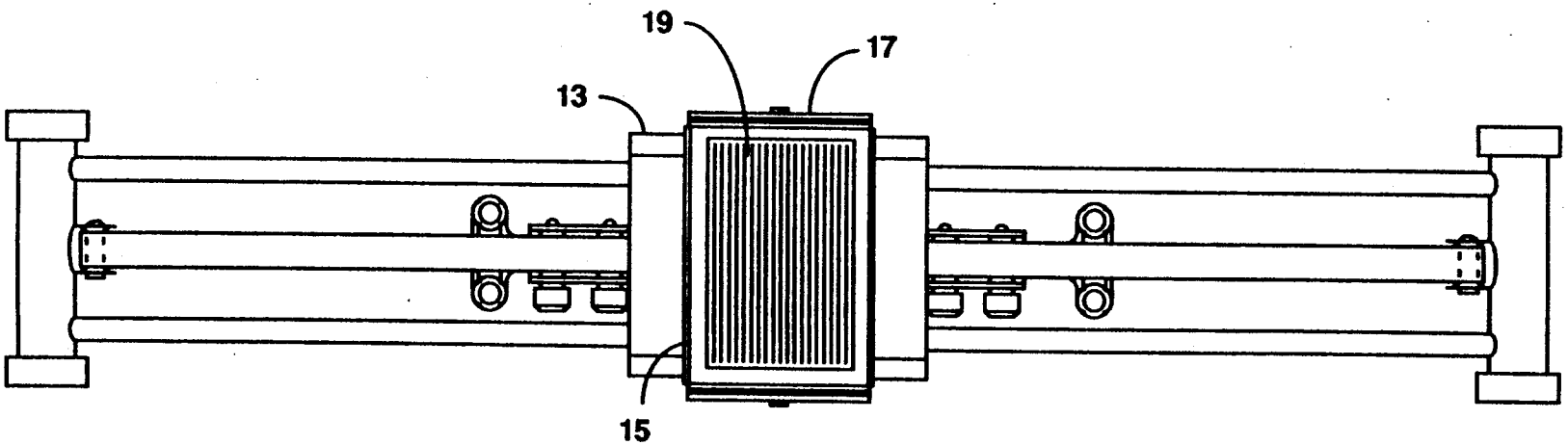
FIG. 1B is a plan view of the apparatus of FIG. 1.
Figure 2:
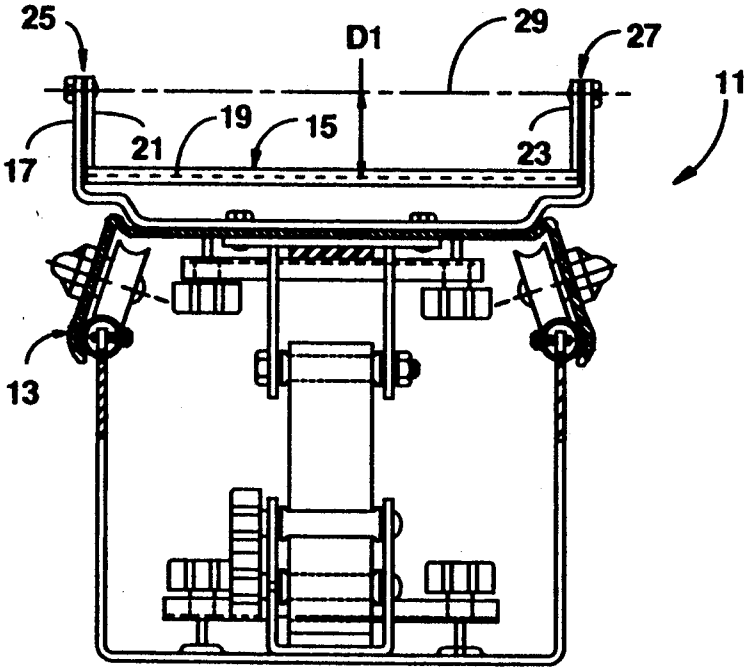
FIG. 2 is a partial section view taken along the section line 2—2 of FIG. 1A to show additional detail.

FIG. 1A and 1B show a side elevation and a top plan view of a ski exercising apparatus 11 according to a preferred embodiment of the invention similar to the devices disclosed in U.S. Pat. No. 4,743,014 and in copending parent application Ser. No. 178,354, but with a single foot platform 15 mounted to a cradle 17. The cradle is in turn fixedly attached in the preferred embodiment to carriage 13 which is constrained by resilient elements to ride on the spaced apart rails of the apparatus. The cradle could as well be a part of the carriage frame and still serve the needed function, but a separate cradle provides modularity in structure. FIG. 2 is a partial section view of the device of FIG. 1 taken along section line 2—2 in FIG. 1A.

In the preferred embodiment cradle 17 is made of formed sheet metal and bolted to carriage 13 by conventional fasteners, although there are other suitable ways that the cradle might be manufactured and mounted. The separate mounting provides modularity so many common parts and assemblies may be used for devices with two foot platforms and devices with one foot platform.

Single foot platform 15 has a surface 19 (FIG. 1B and FIG. 2) where a user places his foot, appending flanges 21 and 23 (FIG. 2) at each end, and is suspended from bearing assemblies at points 25 and 27, so the foot platform acts as a swing, being pivoted above the surface where a user places his or her foot, along a pivot axis 29. In the preferred mode, the platform 15 is dimensioned to fit a single foot, which in the preferred mode is 13 and ⅝ inches long by 5 and ½ inches wide. Although other sizes could be used, in practice it has been found that these dimensions fit a large number of shoe sizes while maintaining an aesthetic and and pleasing look, and will easily accomodate one foot but not two. Pivot axis 19 is at a right angle (90 degrees) to the direction of side to side movement of carriage 13 in operation. In the side to side motion of operating the ski exercising apparatus, a user's weight is applied to surface 19 along a line of action descending from a position about over the center of the device downward to the foot platform. The angle of the line of action is steeper with increased displacement of the carriage, and approximates the line of action of a skier's weight applied to his or her skis when performing an edge turn. The angled line of action together with the fact of the pivot line being above surface 19 causes the foot platform to automatically assume the proper angle and to be self correcting.

Figure 3B:
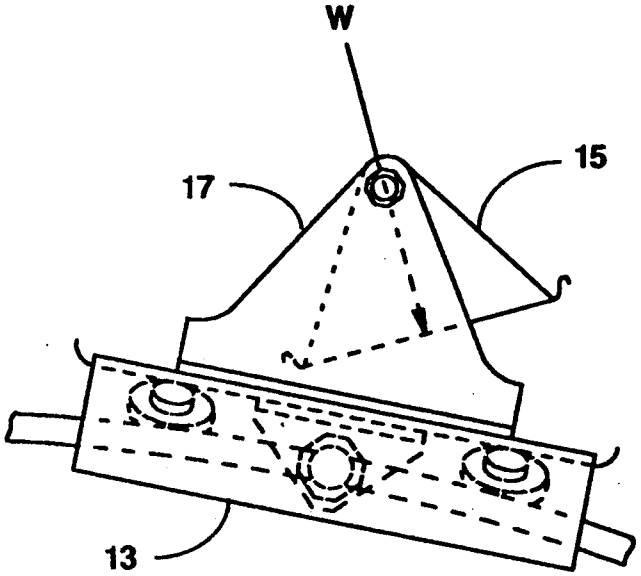
FIG. 3B is similar to FIG. 3A, but with the carriage displaced to the other side.
Figure 3A:
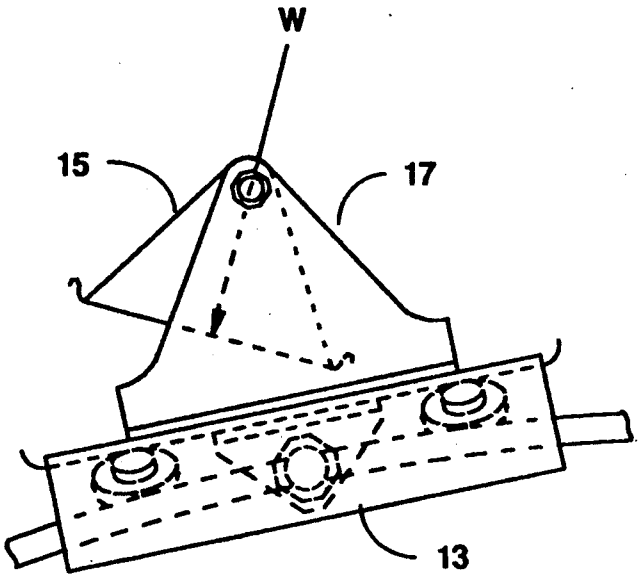
FIG. 3A is a partial side elevation showing the single foot platform of the invention with the carriage displaced to one side and with a force applied by a user indicated as well.

FIG. 3A shows the approximate situation of a user's weight applied to the foot platform with the carriage diplaced significantly to one side, and FIG. 3B shows the same situation with the carriage displaced about the same amount to the opposite side. In the preferred embodiment the distance D1 (FIG. 2) from surface 19 to pivot line 29 is about 8 centimeters, although this dimension is not critical. The dimension needs to be sufficient to allow for the mounting of the pivots and there needs to be sufficient clearance beneath the foot platform so there is no interference with the carriage or cradle with a maximum swing, which is naturally limited by the maximum displacement of the carriage side to side.

In the preferred embodiment the pivot at each of points 25 and 27 is acomplished with a journal bearing, a spacer bushing, and a threaded stud with suitable lock washers and a nut fastener. There are equivalent ways known in the art to accomplish such a pivot.

It will be apparent to a person with skill in the art that there are deviations that might be made from the embodiment shown without departing from the spirit and scope of the invention. For example, there are many ways that a depended foot platform might be manufactured, and still perform the desired function of the invention. There are similarly many ways that the pivots might be accomplished, and other sorts of bearings that would be suitable. The single foot platform could be applied in the depended form disclosed on moveable carriages constrained in many different ways to perform side-to-side motion as well. There are many other changes that could be made without departing from the spirit and scope of the invention.

What is claimed is:

1. A ski exercising apparatus comprising:

two rails positioned in a spaced-apart, parallel relationship;

brace means for holding said rails in said spaced-apart relationship;

carriage means for providing a stable riding area for riding along said rails;

resilient means for providing a restoring force on said carriage means toward the middle of said rails; and a generally U-shaped platform means having only one foot support surface, said foot support surface adequate in size for only one of a user's feet, said platform means pivotally attached at respective legs of the U-shaped platform means to said carriage means to pivot around a horizontal pivot axis above said surface, said pivot axis directed at substantially a right angle to the direction of travel of said carriage, such that said platform means acts as a swing in operation, said platform means such that said surface is maintained at substantially a right angle to the line of action of the force a user applies to said surface;

said carriage means adapted to be attached to only one said platform means.

2. An apparatus as in claim 1 further comprising:

second resilient means for providing a second restoring force on said carriage means toward the middle of said rails;

adjustment means for adjusting the magnitude of said second restoring force, said adjustment means contacting said second resilient means at at least three points, with a first one of said three points located in a vertical plane on one side of the middle of said rails, with a second one of said three points located in a vertical plane on the other side of the middle of said rails, and with a third one of said three points associated with said carriage means and moving therewith.

3. An apparatus as in claim 2 wherein said adjustment means further comprises movement means for moving said first and second points in at least one of a horizontal and a vertical direction, thereby changing the magnitude of the restoring force caused by said second resilient means.

* * * * *